US006638098B2

(12) United States Patent
Yamaoka

(10) Patent No.: US 6,638,098 B2
(45) Date of Patent: Oct. 28, 2003

(54) CONNECTION DETECTING CONNECTOR

(75) Inventor: Atsushi Yamaoka, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 10/158,234

(22) Filed: May 29, 2002

(65) Prior Publication Data

US 2002/0187672 A1 Dec. 12, 2002

(30) Foreign Application Priority Data

Jun. 6, 2001 (JP) ..... 2001-170914

(51) Int. Cl.[7] ..... H01B 3/00
(52) U.S. Cl. ..... 439/489
(58) Field of Search ..... 439/153, 159, 439/152, 345, 370, 489

(56) References Cited

U.S. PATENT DOCUMENTS 6,109,956 A 8/2000 Kawase et al.
6,196,867 B1 3/2001 Kawase et al.
6,241,542 B1 * 6/2001 Nishide et al. ..... 439/489
6,280,237 B1 * 8/2001 Saka et al. ..... 439/489
6,383,009 B2 * 5/2002 Kawase et al. ..... 439/489

* cited by examiner

*Primary Examiner*—Gary Paumen
(74) *Attorney, Agent, or Firm*—Gerald E. Hespos; Anthony J. Casella

(57) ABSTRACT

A female housing (20) has a slider (40) movable oblique to a connecting direction with a male connector housing (10), and a coil spring (30) for biasing the slider (40) forward with respect to the connecting direction. As the housings (10, 20) are connected, a lock (12) of the male housing (10) contacts a lock (42) of the slider (40) to push the slider (40) backward. The locks (12, 42) disengage when the housings (10, 20) reach a properly connected state. Thus, the restoring force of the coil spring (30) returns the slider (40) to its front-end position and the lock (42) engages a rear side of the lock (12). As a result, the housings (10, 20) are locked together.

14 Claims, 11 Drawing Sheets

CONNECTION DETECTING CONNECTOR

BACKGROUND OF THE INVENTION

1. Field of the Invention

The invention relates to a connection detecting connector.

2. Description of the Related Art

A known connection detecting type of connector has male and female housing that can be connected to one another. A spring is incorporated into one housing and is compressed while the housings are being connected with each other. The two housings are separated from each other by a restoring force of the spring if a connecting operation is stopped before the two housings reach a properly connected state. Thus, an operator is notified that the two housings have not yet been connected properly.

Some such connection detecting types of connectors keep the spring compressed even after the housings are connected properly. Thus, the spring may be set permanently in fatigue. U.S. Pat. No. 6,109,956 and FIG. 12 herein disclose a connector in which the spring is permitted to expand when the housings are connected properly. This connector has female and male housings 1, 2 that are connectable with each other. The female housing 1 has a lock arm 4 engageable with a locking projection 3 of the male housing 2 and a slider 5 that is movable in forward and backward directions. A coil spring 6 is accommodated in the slider 5. The leading end of the lock arm 4 moves onto the locking projection 3 as the housings 1, 2 are connected and engages the slider 5, as shown in FIG. 13. Thus, a backward movement of the slider 5 is prevented, and the coil spring 6 is compressed as the connection proceeds (see FIG. 14). When the two housings 1, 2 are properly connected, the lock arm 4 returns to its original position to engage the locking projection 3 and is disengaged from the slider 5. Thus, the coil spring 6 is restored and is located at a position more backward than its original position.

Operations of locking and unlocking the slider 5 are linked with the movements of the lock arm 4 or the coil spring 6 is moved forward and backward to compress and release the coil spring 6 as the connecting operation proceeds in this connector. Thus, the entire construction has become disadvantageously complicated.

In view of the above, an object of the present invention is to provide a connection detecting connector having a simple construction.

SUMMARY OF THE INVENTION

The invention is directed to a connection detecting connector, that is, a connector in which an improper connection of connector housings can be detected or avoided. The connector comprises first and second housings that are connectable with and separable from each other. The first housing comprises a slider that can be moved at an angle to a connecting direction of the two housings and a biasing member for biasing the slider forward with respect to the connecting direction. A pushing portion is provided at the second housing for contacting and pushing a pushable portion of the slider while the housings are being connected. Thus, the slider is moved back with respect to the connecting direction and a force is accumulated in the biasing member. The housings are pushed apart by a restoring force of the biasing member if the connecting operation is interrupted before the housings are connected properly. Thus, a partly connected state can be detected. However, the pushing portion and the pushable portion disengage when the housings are near or at a properly connected state. Thus, the biasing member is at least partly restored and moves the slider forward with respect to the connecting direction. It is unnecessary to link the locking or unlocking of the slider with movements of a lock arm. Therefore, the construction is simple.

The slider preferably has a lock for engaging a rear side of an engaging portion of the second housing when the biasing member is restored to its initial shape. More particularly, the slider moves oblique to the connecting direction and the lock of the slider engages the rear side of the engaging portion of the second housing when the housings reach the properly connected state. As a result, the two housings are locked together without a separate locking means, such as a lock arm, and the construction of the connector can be made even simpler.

The lock and the engaging portion may comprise slanted surfaces that extend substantially along a moving direction of the slider and that engage each other. For example, the engaging portion may comprise a recess formed on a lateral surface of the second housing.

The pushable portion also may act as the locking portion and/or the pushing portion also may act as the engaging portion.

The slider may be accommodated in the first housing and may comprise an unlocking projection for moving the slider backward with respect to the connecting direction. The unlocking projection may be in a groove in the outer surface of the first housing. Accordingly, the slider is not likely to be moved inadvertently to separate the two housings from each other.

The pushing portion may comprise a projection that projects laterally from the second housing. Alternatively, the pushing portion may comprise a front edge of the second connector housing.

The slider may comprise at least one guide to interact with at least one corresponding mating guide in the first housing for guiding a movement of the slider along its movement direction. The slider may also comprise at least one stop for stopping a forward movement of the slider at a front-stop position.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

A connection detecting connector according to a first embodiment of the invention is comprised of a male housing 10 and a female housing 20 connectable with and separable from each other, as shown in FIGS. 1 to 7. In the following description, sides of the male and female housings 10, 20 to be connected are referred to as the front.

Figure 1:
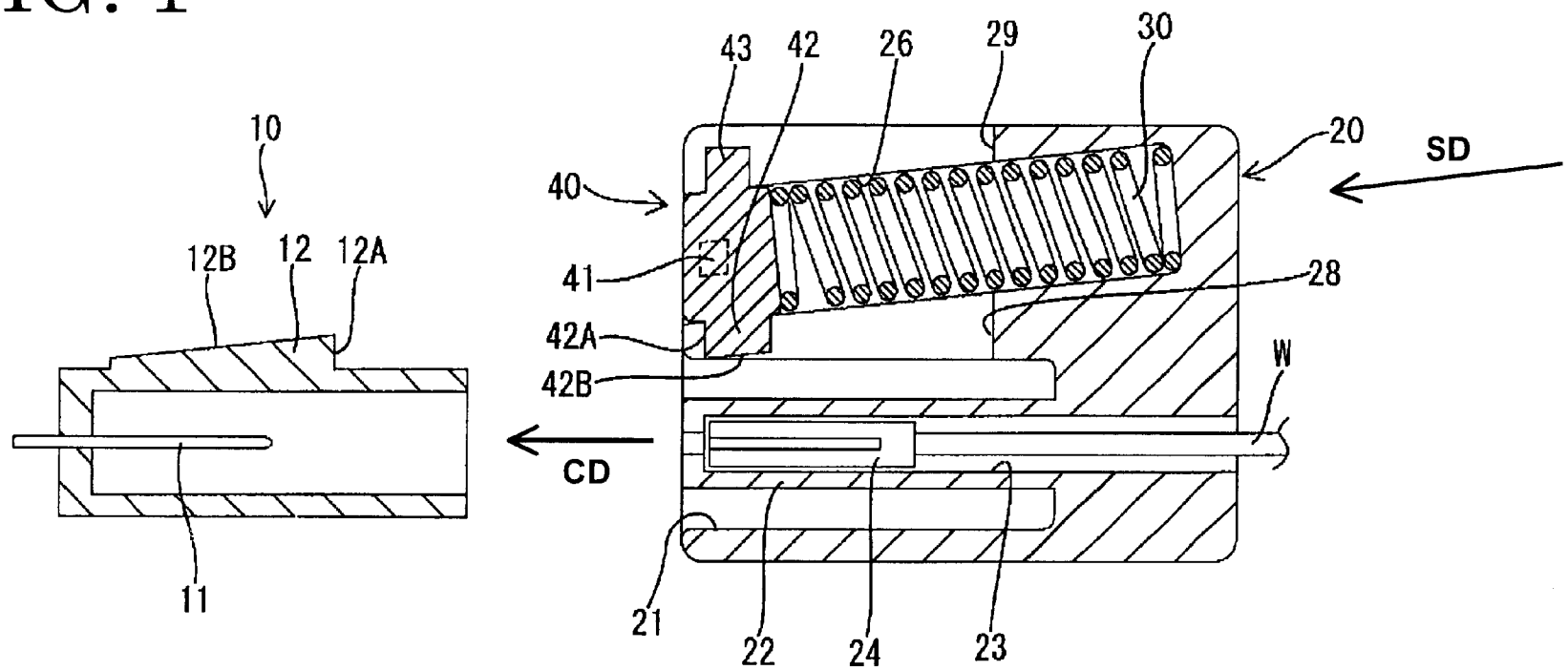
FIG. 1 is a longitudinal section showing a state of a first embodiment before male and female connector housings are connected.
Figure 2:
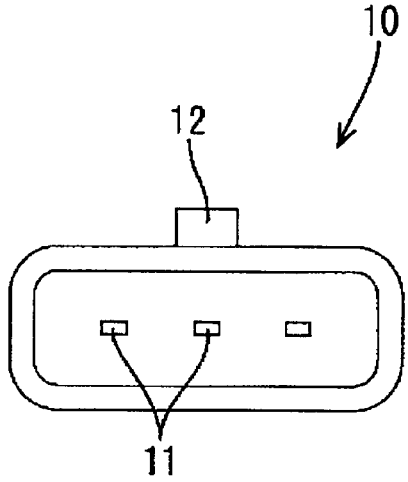
FIG. 2 is a front view of the male connector housing.

The male housing 10 is connectable with an unillustrated electrical device or appliance, and is a substantially rectangular synthetic resin tube that opens forwardly, as shown in FIGS. 1 and 2. Male terminal fittings 11 project inside the male housing 10 and are arrayed substantially side by side. A lock 12 is formed substantially at a widthwise center of the upper surface of the male housing 10. The front surface of the lock 12 defines a pushing surface 12A that extends substantially normal to the connecting direction CD, whereas the upper surface thereof is a slanted surface 12B that is inclined moderately upward to the front.

Figure 3:
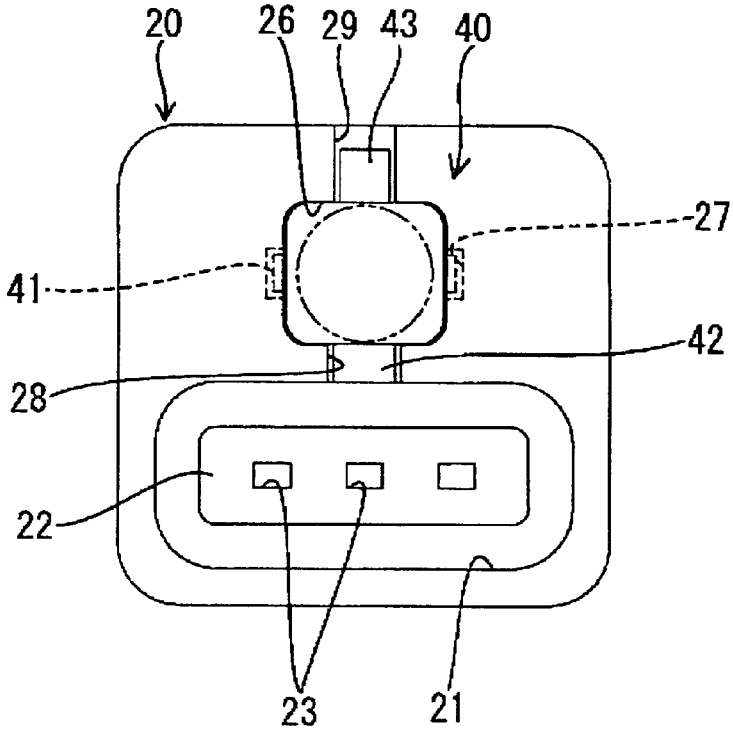
FIG. 3 is a front view of the female connector housing.
Figure 4:
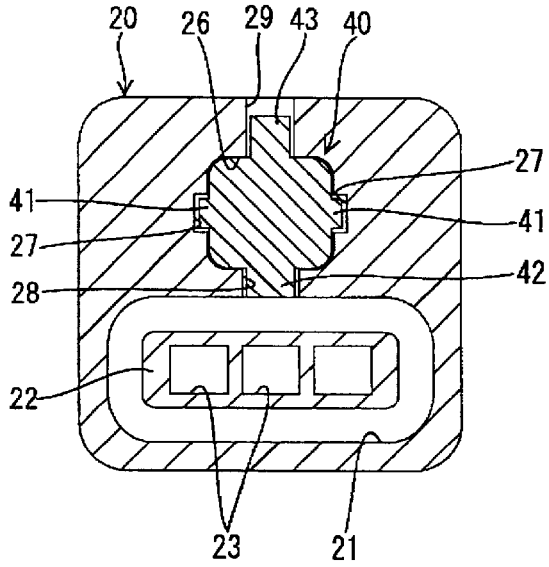
FIG. 4 is a front view in section of the female connector housing.

The female housing 20 also is made of a synthetic resin and defines a substantially rectangular parallelepipedic shape, as shown in FIGS. 1, 3 and 4. A fittable portion 21 is formed at the bottom front of the female housing 20 and is configured to receive the male housing 10. A rectangular tubular projecting portion 22 projects from the back surface of the fittable portion 21, and substantially side-by-side cavities 23 penetrate the projecting portion 22 substantially in forward and backward directions. Female terminal fittings 24 connected with ends of wires W are accommodated in the respective cavities 23, and can be electrically connected with the male terminal fittings 11 when the male and female housings 10, 20 are connected with each other.

A spring accommodating portion 26 extends substantially forward and backward substantially at a widthwise center of the upper part of the female housing 20, and is in a position that substantially corresponds to the lock 12. The spring accommodating portion 26 is open at the front surface of the female housing 20 and has a substantially square cross section. Additionally, the spring accommodating portion 26 is sloped moderately down to the front, and hence is further from the fittable portion 21 as it extends toward the rear of the female housing 20. More particularly, the spring accommodating portion 26 extends in a direction SD arranged at an angle of between 0° and about 45° with respect to the connecting direction CD. Longitudinally extending guide grooves 27 are formed in the left and right side surfaces of the spring accommodating portion 26, and a front-stop wall 27A is provided at the front end of each guide groove 27 (see FIG. 5). A penetrating groove 28 extends rearwardly from the front end of the female housing 20 and communicates with both the spring accommodating portion 26 and the fittable portion 21.

A coil spring 30 and a slider 40 are accommodated in the spring accommodating portion 26. The coil spring 30 has a rear end that is held in contact with the back wall of the spring accommodating portion 26 and a front end that is held in contact with the slider 40. The slider 40 is made e.g. of a synthetic resin, and has a main body with a substantially square cross section. Stoppers 41 project from the left and right sides of the slider 40, and fit in the longitudinally extending guide grooves 27 of the spring accommodating portion 26. The stoppers 41 can move in the guide grooves 27 so that the slider 40 moves along the spring accommodating portion 26 in a direction oblique to the connecting direction CD. The stoppers 41 engage the front-stop walls 27A when the slider 40 is at a front-end position (see FIG. 1) in the spring accommodating portion 26 to prevent the slider 40 and the spring 30 from coming out. The slider 40 is biased forward towards its front-end position by the coil spring 30. However, the coil spring 30 is substantially in its natural state where no force acts thereon when the slider 40 is at its front-end position.

A lock 42 is formed substantially in a widthwise center of the bottom of the slider 40 and is movably disposed in portions of the penetrating groove 28 adjacent the spring accommodating portion 26. The lock 42 of the male housing 10 also is insertable into the penetrating groove 28. The front of the lock 42 defines a pushable surface 42A that extends substantially normal to the connecting direction CD and the bottom of the lock 42 defines a slanted surface 42B that is sloped moderately down to the front. The inclinations of this slanted surface 42B of the slider 40 and the slanted surface 12B of the lock 12 are substantially parallel to the longitudinal direction SD of the spring accommodating portion 26, and hence parallel to the a moving direction SD of the slider 40.

The pushing surface 12A of the lock 12 on the male housing 10 contacts the pushable surface 42A of the lock 42 on the slider 40 when the male and female housings 10, 20 are connected. Thus, the slider 40 is pushed back along the connecting direction CD from the front end position. The slider 40 reaches the rear-end position shown in FIG. 6 when the housings 10, 20 are connected properly. However, the pushing surface 12A of the lock 12 and the pushable surface 42A of the lock 42 are dimensioned so they are no longer engaged at this stage.

An unlocking projection 43 is formed on the top of the slider 40 and is used to move the slider 40 from its front-end position to its rear-end position. On the other hand, the female housing 20 is formed with a groove 29 that extends from the spring accommodating portion 26. The groove 29 is open in the front and upper surfaces of the female housing 20. The unlocking projection 43 is movably guided forward and backward in the groove 29. The unlocking projection 43 never projects out from the upper surface of the female connector housing 20 at any position between the front-end position and the rear-end position in the groove 29.

Figure 5:
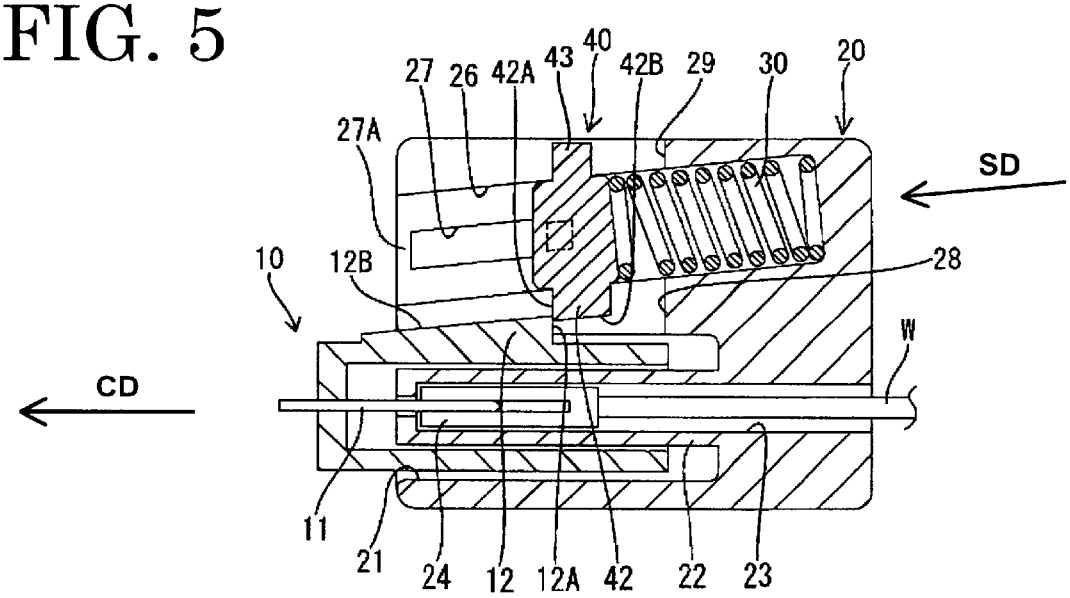
FIG. 5 is a longitudinal section showing an intermediate stage of compression of a coil spring.

Connection is achieved by first positioning the housings 10, 20 opposed to each other, as shown in FIG. 1, so that the lock 12 of the male housing 10 aligns with the penetrating groove 28 of the female housing 20. The male housing 10 then is pushed into the fittable portion 21 of the female housing 20. Thus, the pushing surface 12A of the lock 12 contacts the pushable surface 42A of the lock 42. As the male housing 10 is pushed further, the slider 40 is pushed back along the spring accommodating portion 26, as shown in FIG. 5, thereby compressing the coil spring 30. The slider 40 moves higher as it moves back due to the inclination of the spring accommodating portion 26. Consequently, an area of the pushing surface 12A of the lock 12 engaged by the pushable surface 42A of the lock 42 is reduced gradually.

A resilient restoring force of the coil spring 30 separates the housings 10, 20 if the connecting operation is stopped before the two housings 10, 20 reach a properly connected state. As a result, an operator can detect that the two housings were left only partly connected.

Figure 6:
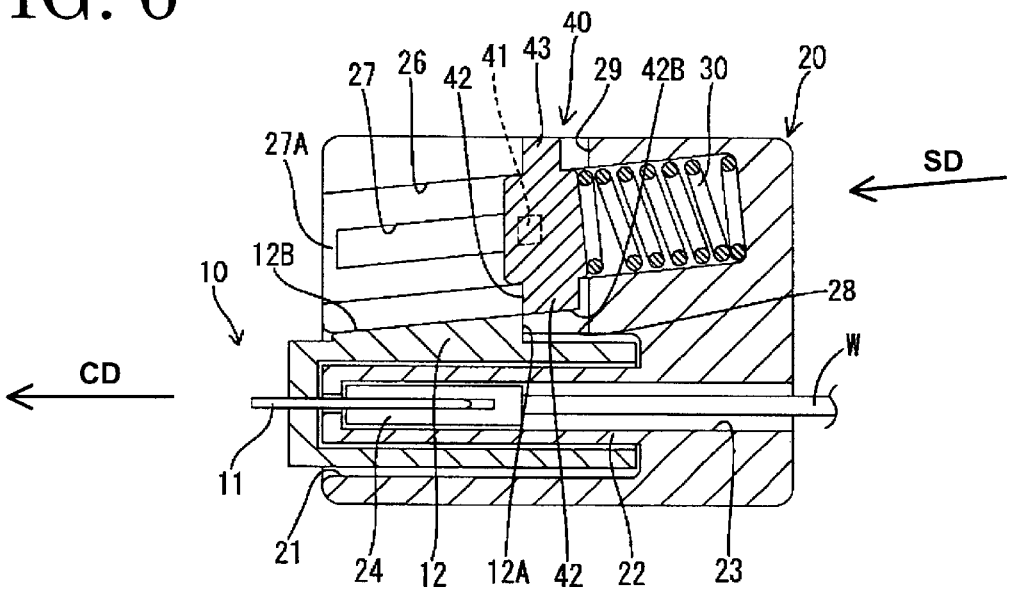
FIG. 6 is a longitudinal section showing a state attained when a slider reaches its rear-end position.
Figure 7:
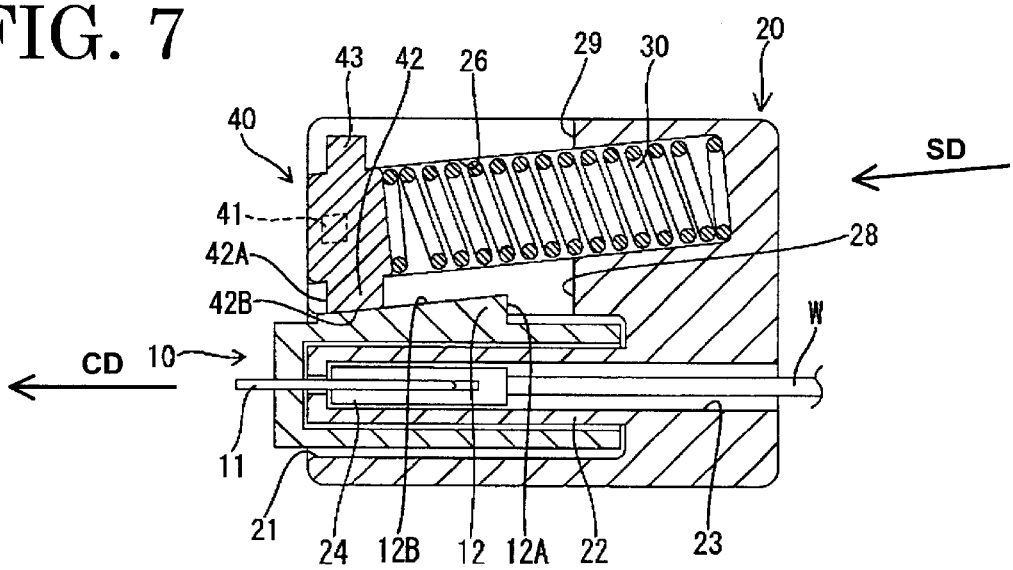
FIG. 7 is a longitudinal section showing a state attained when the slider returns to its front-end position.
Figure 8:
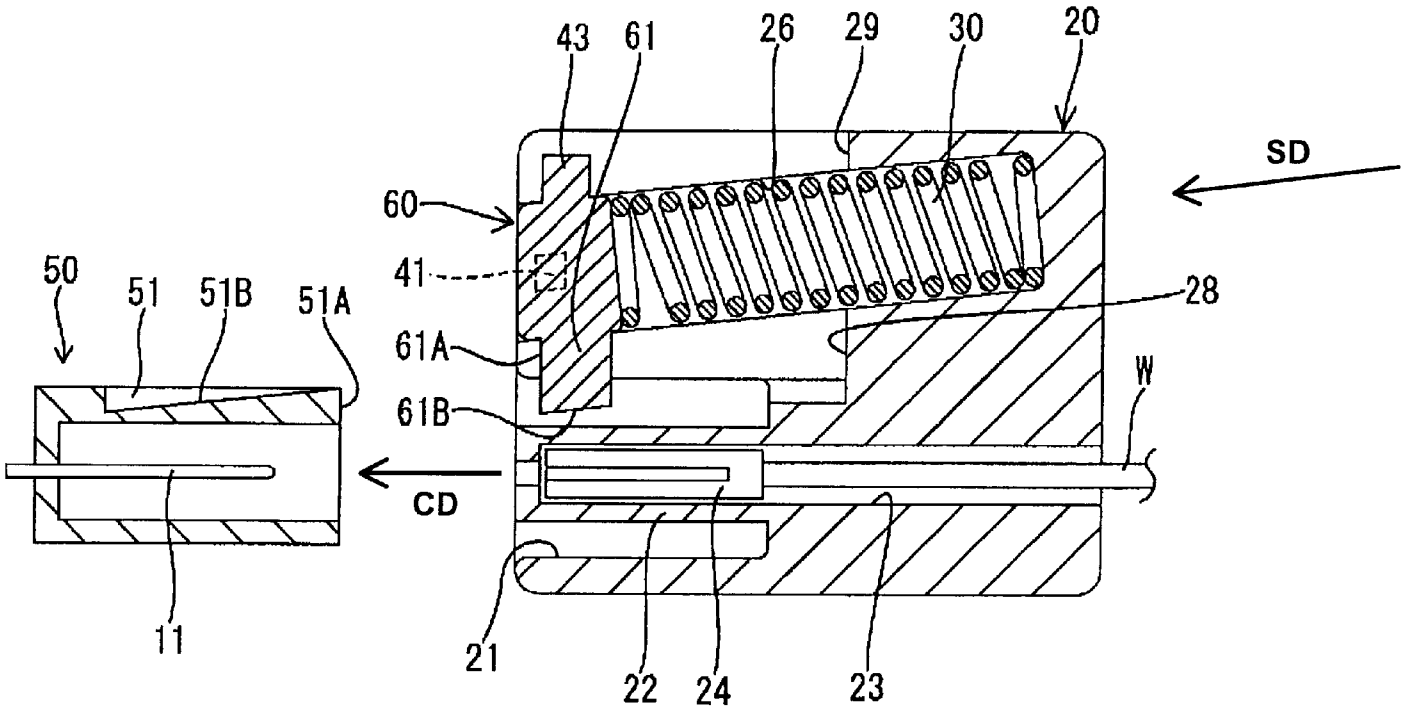
FIG. 8 is a longitudinal section showing a state of another embodiment before male and female connector housings are connected.
Figure 9:
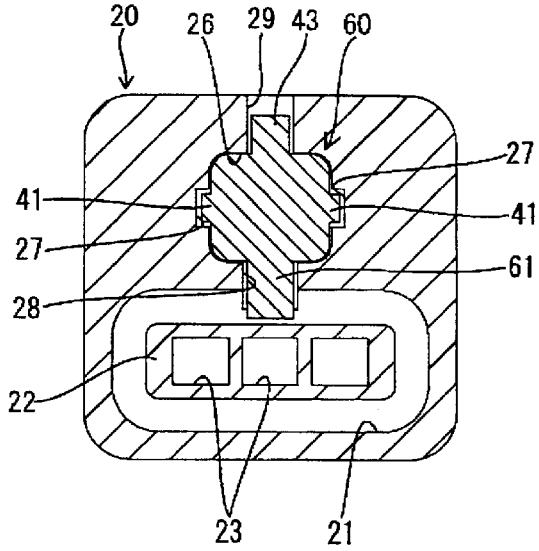
FIG. 9 is a front view in section of the female connector housing.
Figure 10:
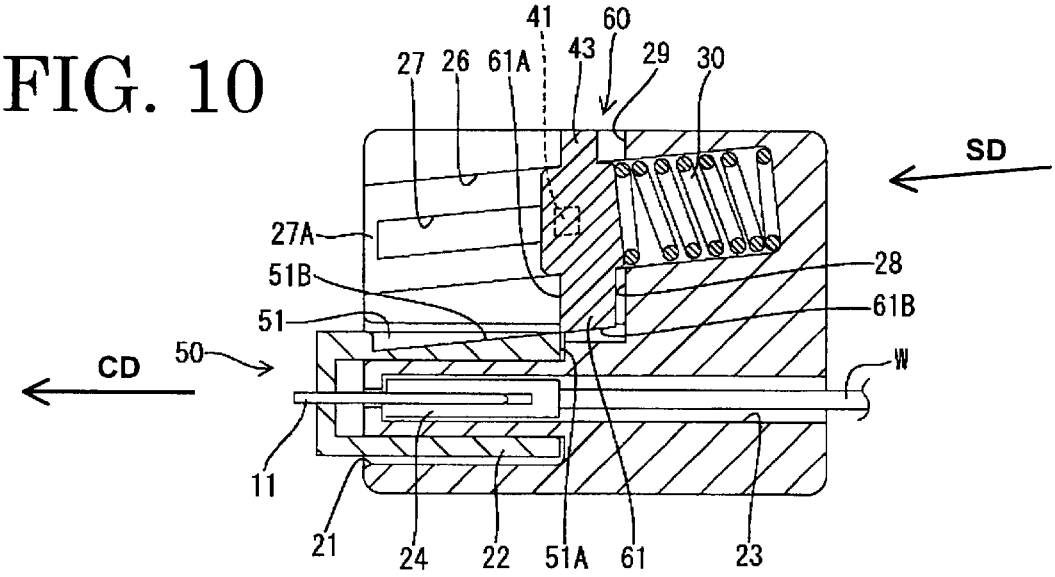
FIG. 10 is a longitudinal section showing a state attained when a slider reaches its rear-end position.
Figure 11:
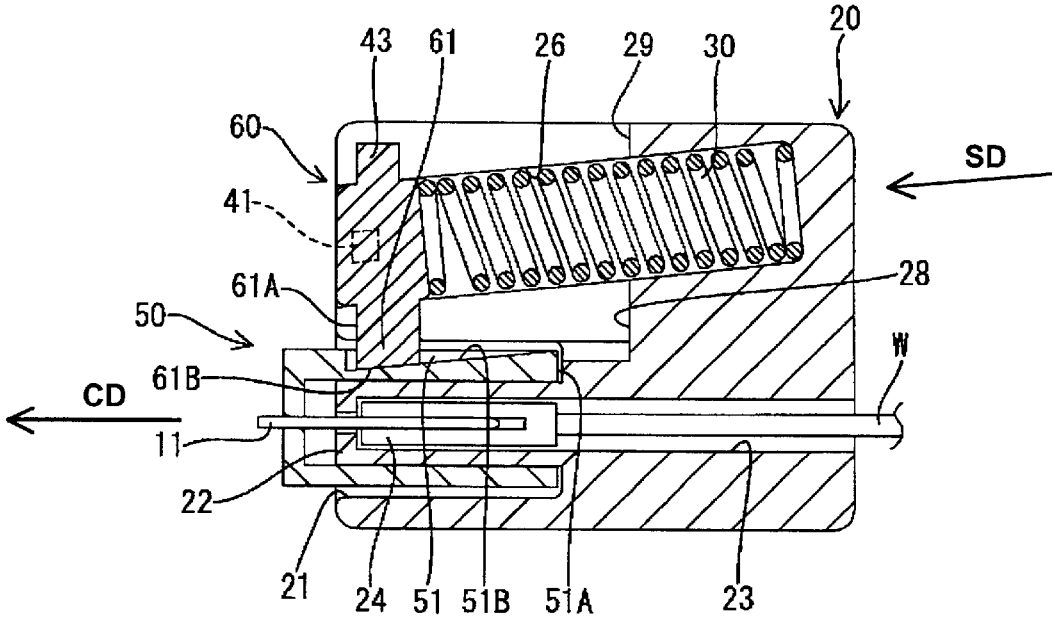
FIG. 11 is a longitudinal section showing a state attained when the slider returns to its front-end position.
Figure 12:
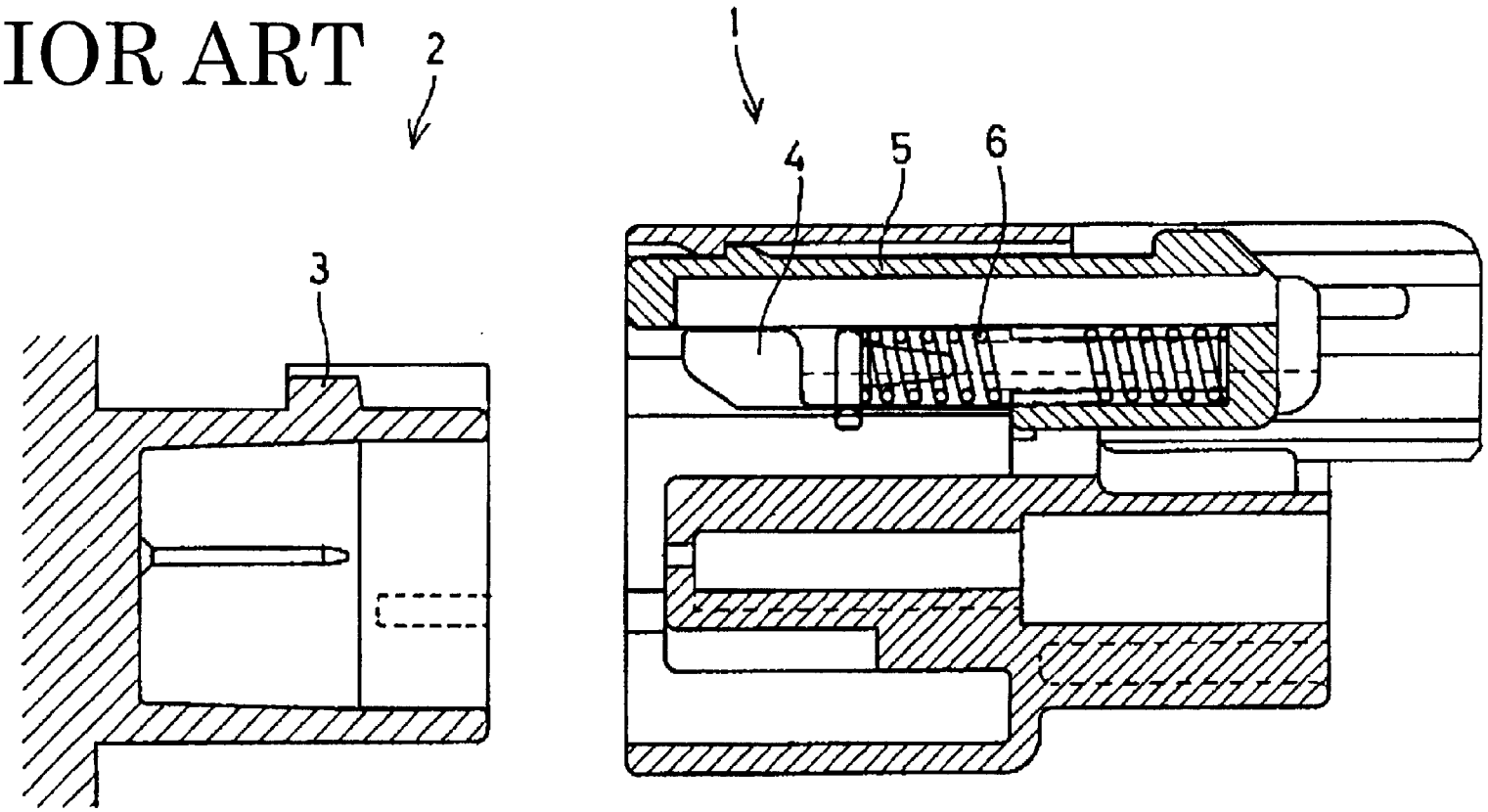
FIG. 12 PRIOR ART
FIG. 12 is a longitudinal section showing a state before two connector housings of a prior art connector are connected.
Figure 13:
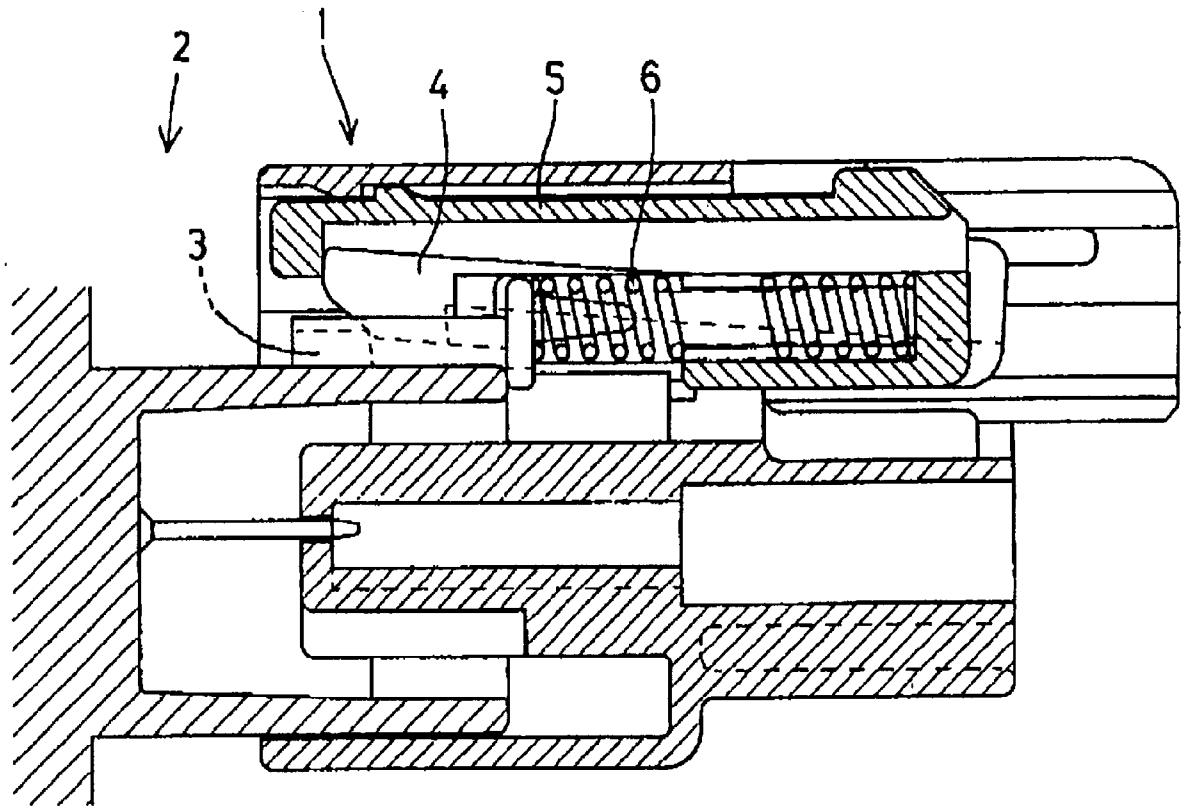
FIG. 13 PRIOR ART
FIG. 13 is a longitudinal section showing a state attained when a lock arm moves onto a locking projection.
Figure 14:
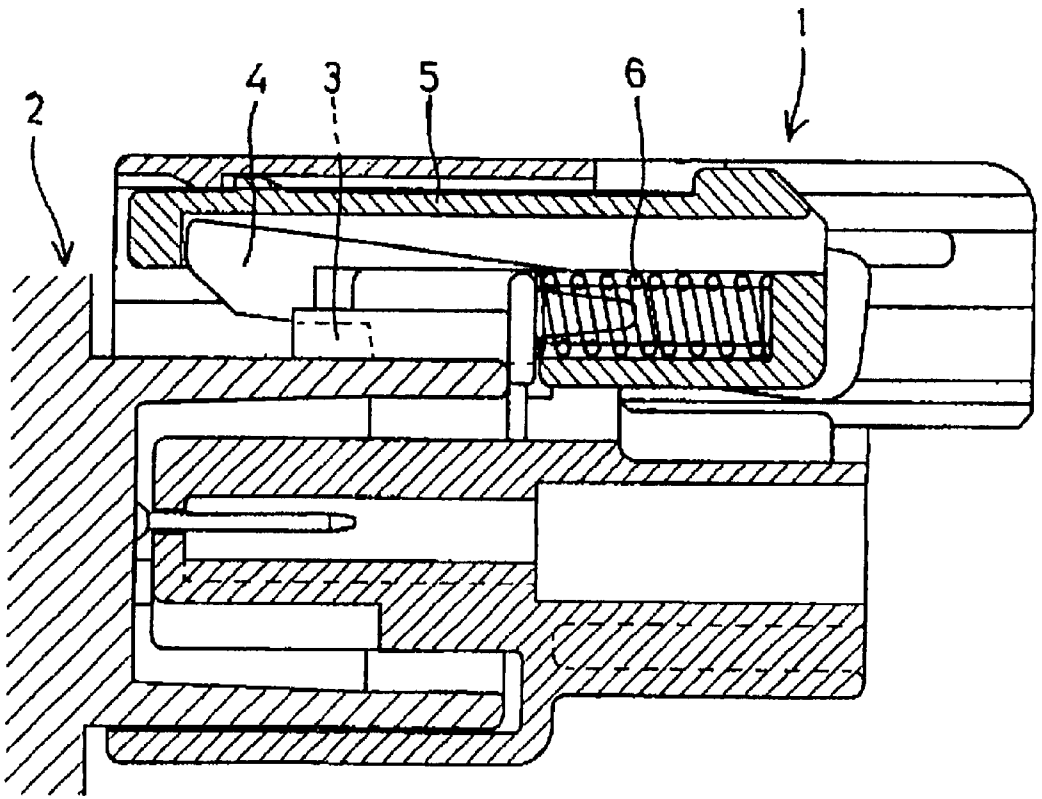
FIG. 14 PRIOR ART
FIG. 14 is a longitudinal section showing a state where a spring is compressed.
Figure 15:
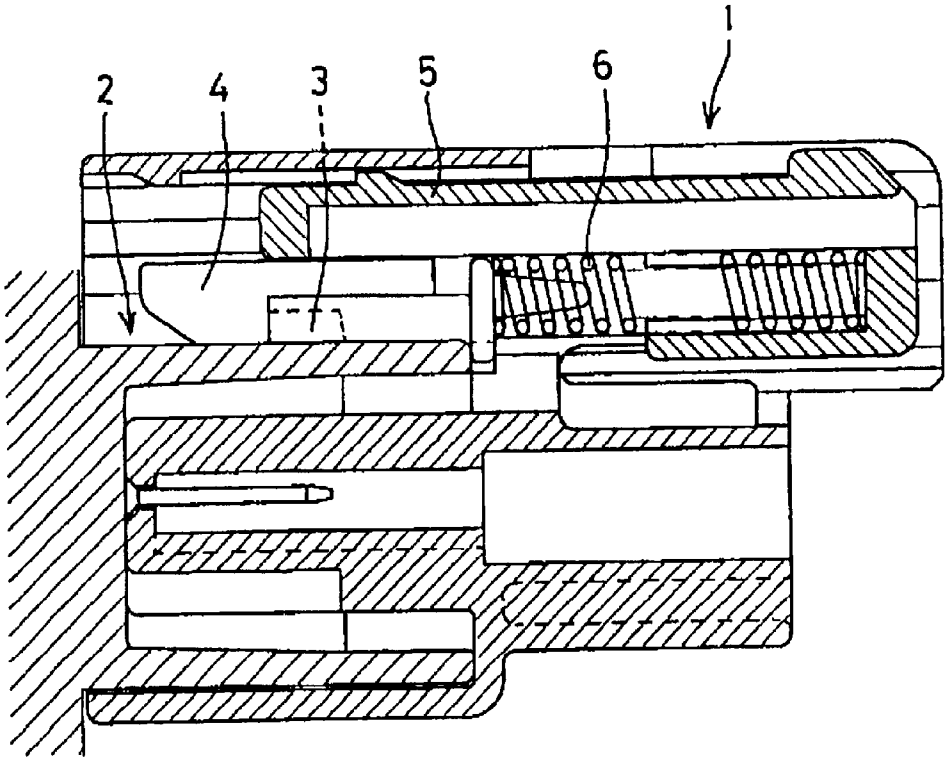
FIG. 15 PRIOR ART
FIG. 15 is a longitudinal section showing a properly connected state.

The slider 40 reaches the rear-end position shown in FIG. 6 substantially as the housings 10, 20 become properly connected. Simultaneously, the pushing surface 12A of the lock 12 disengages from the pushable surface 42A of the lock 42. Thus, the restoring force of the coil spring 30 moves the slider 40 forward along the spring accommodating portion 26 while holding the slanted surfaces 12B, 42B in sliding contact with each other. The stoppers 41 contact the front-stop walls 27A of the guide grooves 27 to stop the slider 40 at its front-end position, as shown in FIG. 7, with the coil spring 30 substantially in its natural state. Further, the slanted surface 42B of the lock 42 of the slider 40 is engaged with the slanted surface 12B of the lock 12 of the male housing 10. Thus, the male and female housings 10, 20 are locked together.

The two housings are separated by pushing the unlocking projection 43 back using a jig to locate the slider 40 at the rear-end position shown in FIG. 6. Thus, the slanted surfaces 12B, 42B of the locks 12 and 42 disengage, and the housings 10, 20 can be separated from each other.

As described above, according to this embodiment, the housings 10, 20 are separated from each other by the resilient restoring force of the coil spring 30 if the connecting operation is interrupted before the housings 10, 20 are connected properly. Thus, the partly connected state can be detected. Further, the surfaces 12A and 42A are no longer engaged when the properly connected state is reached. Thus, the coil spring 30 is restored to its initial shape and the slider 40 is moved forward with respect to the connecting direction CD. It is not necessary to provide, a mechanism for linking operations of locking and unlocking the slider with the movements of the lock arm as in the prior art. Thus, the construction of the connector can be simpler. Further, since the coil spring is not moved forward and backward together with the slider as in the prior art, a dimension of the female connector housing 20 in forward and backward directions can be reduced.

The slider 40 is moved in the direction SD oblique to the connecting direction CD when the two housings 10, 20 reach the properly connected state and the lock 42 engages the rear side of the lock 12 of the male housing 10 to lock the housings 10, 20 together. The construction can be simpler since it is not necessary to separately provide a locking means such as a lock arm.

The locks 12 and 42 are formed with the slanted surfaces 12B, 42B substantially parallel with the moving direction SD of the slider 40. The slider 40 is moved to its front-end position by the restoring force of the coil spring 30 when the housings 10, 20 reach the properly connected state (FIG. 7) and is locked with the slanted surfaces 12B, 42B held substantially in contact with each other. Thus, the two housings 10, 20 are locked together.

The unlocking projection 43 of the slider 40 does not project out of the groove 29. Therefore, the slider 40 cannot be moved inadvertently in a direction that would separate the housings 10, 20.

FIGS. 8 to 11 show a second embodiment that differs from the first embodiment mainly in the shapes of a male housing 50 and a slider 60. Elements that are substantially same as the first embodiment are identified by the same reference numerals, but are not described again.

The second embodiment has a slider 60 with a lock 61 that is longer than that of the first embodiment. A leading end of the lock 61 projects into the fittable portion 21 through the penetrating groove 28. The front of the lock 61 defines a pushable surface 61A that extends substantially normal to the connecting direction CD and the bottom of the lock 61 defines a slanted surface 61B inclined to be parallel with a moving direction of the slider 60. On the other hand, a locking recess 51 is formed in the upper surface of the male housing 50, and the bottom of the male housing 50 defines a slanted surface 51 that extends substantially along the moving direction SD of the slider 60. An upper front end surface of the male housing 10 defines a pushing surface 51A, and the upper edge of the pushing surface 51A meets the front edge of the slanted surface 51B.

As the male and female housings 50, 20 are connected, the pushing surface 51A contacts the pushable surface 61A of the lock 61. Thus, the slider 60 is moved to the rear and compresses the coil spring 30. An engaging area of the pushing surface 51A of the male housing 10 and the pushable surface 61A of the lock 61 is reduced gradually as the connection proceeds. The slider 60 reaches its rear-end position when the housings 50, 20 reach the properly connected state shown in FIG. 10, and the pushing surface 51A no longer engages the pushable surface 61A. Consequently, the restoring force of the coil spring 30 moves the slider 60 forward along the spring accommodating portion 26 while holding the slanted surfaces 51B, 61B in sliding contact with each other. The slanted surface 61B of the lock 61 engages the slanted surface 51B of the locking recess 51 when the slider 60 reaches the front-end position shown in FIG. 11. As a result, the male and female housings 50, 20 are locked together.

According to this embodiment, it is not necessary to provide a projection on the upper surface of the male housing, and the male housing 50 can be made smaller.

The present invention is not limited to the above described and illustrated embodiments. For example, following embodiments are also embraced by the technical scope of the present invention as defined in the claims. Beside the following embodiments, various changes can be made without departing from the scope and spirit of the present invention as defined in the claims.

The slider and the spring may be mounted in the male connector housing according to the present invention.

The slider need not be in locked engagement with the mating housing after the two housings are connected properly. It is sufficient for the slider to separate the two housings when they are left partly connected. Further, a locking means, such as a lock arm. for locking the two housings together may be provided separately.

The lock 12 serves both as the pushing portion and the engaging portion, and the lock 42 serves both as the pushable portion and the locking portion in the first embodiment. However, the pushing portion and the engaging portion or the pushable portion and the locking portion may be separate. Further, the locking portion or the engaging portion may not be formed with the slanted surface extending along the moving direction of the slider.

Even though in the preferred embodiments the pushing portion and/or the engaging portion have been described to be either a lock 12 or a recess 51 it should be understood that they can also be embodied by having both a recessed and a projecting portion at the same time.

What is claimed is:

1. A connection detecting connector, comprising:

first and second housings (10, 20; 50, 20) connectable with and separable from each other along a connecting direction (CD), the first housing (20) comprising a slider (40; 60) movable in a direction (SD) oblique to the connecting direction (CD) and a biasing member (30) for biasing the slider (40; 60) forward with respect to the connecting direction (CD), wherein:

a pushing portion (12; 51) provided at the second housing (10, 50) for contacting and pushing a pushable portion (42; 61) of the slider (40; 60) while the housings (10, 20; 50, 20) are being connected, and for moving the slider (40; 60) backward with respect to the connecting direction (CD) while accumulating a force in the biasing member (30), and the pushing portion (12; 51) and the pushable portion (42; 61) disengaging when the housings (10, 20; 50, 20) substantially reach a properly connected state (FIGS. 6; 10), whereby the biasing member (30) is at least partly restored while moving the slider (40; 60) forward with respect to the connecting direction (CD).

2. The connection detecting connector of claim 1, wherein, when the biasing member (30) is restored in the properly connected state (FIGS. 6, 10), a lock (42; 61) of the slider (40; 60) engages a rear side of an engaging portion (12; 51) of the second housing (10; 50) with respect to the connecting direction (CD) to lock the two housings (10, 20; 50, 20) together.

3. The connection detecting connector of claim 2, wherein the lock (42; 61) and the engaging portion (12; 51) both comprise a slanted surface (12B, 42B; 51B, 61B) substantially extending along a moving direction (SD) of the slider (40; 60), the lock (42; 61) and the engaging portion (12; 51) being engageable with each other while the slanted surfaces (12B, 42B; 51B, 61B) are held substantially in contact.

4. The connection detecting connector of claim 3, wherein the engaging portion (51) comprises a recess (51) formed on a surface of the second housing (10, 50).

5. The connection detecting connector of claim 4, wherein the pushable portion (42; 61) also acts as the locking portion (42; 61) and the pushing portion (12; 51) also acts as the engaging portion (12; 51).

6. The connection detecting connector of claim 1, wherein the slider (40; 60) is accommodated in the first housing (20) and comprises an unlocking projection (43) for moving the slider (40; 60) backward with respect to the connecting direction (CD).

7. The connection detecting connector of claim 6, wherein the unlocking projection (43) is in a groove (29) formed in the surface of the first housing (20) so as not to project out of the groove (29).

8. The connection detecting connector of claim 1, wherein the pushing portion (12) comprises a projection (12) laterally projecting from the second housing (10).

9. The connection detecting connector of claim 1, wherein the slider (40; 60) comprises at least one guide (41; 61) to interact with at least one corresponding mating guide (27) in the first housing (10) for guiding a movement of the slider (40; 60) along its movement direction (SD).

10. The connection detecting connector of claim 1, wherein the slider (40; 60) comprises at least one for stopping a forward movement of the slider (40; 60) at a front-stop position (FIGS. 1, 7; 8, 11).

11. A connection detecting connector, comprising:

first and second housings (10, 20; 50, 20) having front ends that are connectable with one another by moving said housings (10, 20; 50, 20) along a connecting direction (CD);

a slider (40; 60) mounted in the first housing (20) for movement in a moving direction (SD) oblique to the connecting direction (CD), the slider (40; 60) having a pushable surface (42; 61) facing towards the front end of the first housing (20);

a biasing member (30) for biasing the slider (40; 60) toward the front end of the first housing (20);

a pushing surface (12; 51) formed on the second housing (10, 50) and aligned for contacting the pushable surface (42; 61) of the slider (40; 60) while the housings (10, 20; 50, 20) are being connected, and for moving the slider (40; 60) along the moving direction (SD) while accumulating a force in the biasing member (30), and the pushable portion (42; 61) disengaging from the pushing portion (12; 51) when the housings (10, 20; 50, 20) substantially reach a properly connected state (FIGS. 6; 10) such that the biasing member (30) is at least partly restored and returns the slider (40; 60) towards the front end of the first housing (20).

12. The connection detecting connector of claim 11, wherein the biasing member (30) biases the slider (40; 60) into a position for engaging the second housing (10; 50) to lock the two housings (10, 20; 50, 20) together.

13. The connection detecting connector of claim 12, wherein the slider (40; 60) and the second housing (10; 50) both comprise a slanted surface (12B, 42B; 51B, 61B) substantially extending along the moving direction (SD) of the slider (40; 60), the slanted surfaces (12B, 42B; 51B, 61B) being held in contact for locking the housings (10, 20; 50, 20) together.

14. The connection detecting connector of claim 13, wherein the slider (40; 60) is accommodated in the first housing (20) and comprises an unlocking projection (43) for moving the slider (40; 60) backward with respect to the connecting direction (CD).

* * * * *